US005155908A

United States Patent [19]

Arndt et al.

[11] Patent Number: 5,155,908

[45] Date of Patent: Oct. 20, 1992

[54] METHOD FOR ASSEMBLING A ONE-PIECE ROTOR SYSTEM AND A PUMP RING FOR A TWO-STAGE VACUUM PUMP

[75] Inventors: Lutz Arndt, Troisdorf; Winfried Kaiser; Peter Müller, both of Cologne, all of Fed. Rep. of Germany

[73] Assignee: Leybold Aktiengesellschaft, Hanau, Fed. Rep. of Germany

[21] Appl. No.: 692,130

[22] Filed: Apr. 26, 1991

[30] Foreign Application Priority Data

May 29, 1990 [DE] Fed. Rep. of Germany ..... 4017192

[51] Int. Cl.[5] ..... B23P 15/00

[52] U.S. Cl. ..... 29/888.025; 29/888.02; 418/179

[58] Field of Search ..... 29/888.02, 888.021-888.025; 415/216.1, 217.1; 417/68, 410; 418/179, 255

[56] References Cited

U.S. PATENT DOCUMENTS 2,246,272 6/1941 Davidson ..... 29/888.025 X
4,242,065 12/1980 Ishizuka et al. ..... 418/179 X
4,561,837 12/1985 Berges et al. ..... 418/255
4,706,353 11/1987 Zgliczynski et al. ..... 29/888.025
4,746,270 5/1988 Hale et al. ..... 29/888.025 X
4,826,408 5/1989 Inoue et al. ..... 29/888.025 X
4,940,398 7/1990 Berges et al. ..... 417/40

FOREIGN PATENT DOCUMENTS 1454014 10/1976 United Kingdom .

*Primary Examiner*—Joseph M. Gorski
*Assistant Examiner*—Peter Dungba Vo
*Attorney, Agent, or Firm*—Felfe & Lynch

[57] ABSTRACT

The invention relates to a method of making a pump ring for a two-stage vacuum pump (1) with a one-piece rotor system (14) having three sections (14*a*, *b*, *c*), whose end sections (14*a* and 14*c* form the two pumping stages and whose middle section (14*b*) forms an intermediate bearing, the diameters of the bearing section (14*b*and of the rotor section (14*a*) forming the forepumping stage being equal. To reduce the tolerances that occur it is proposed that two bores be made in a single set-up from one end of a substantially cylindrical workpiece, the one forming the anchor contact (51) of the forepumping stage as well as the bearing bore (12) and the other forming the anchor contact (52) of the high-vacuum stage, and that before or after these bores aremade, additional bores (11, 13) are made in order to form the pump chambers (21, 17).

3 Claims, 3 Drawing Sheets

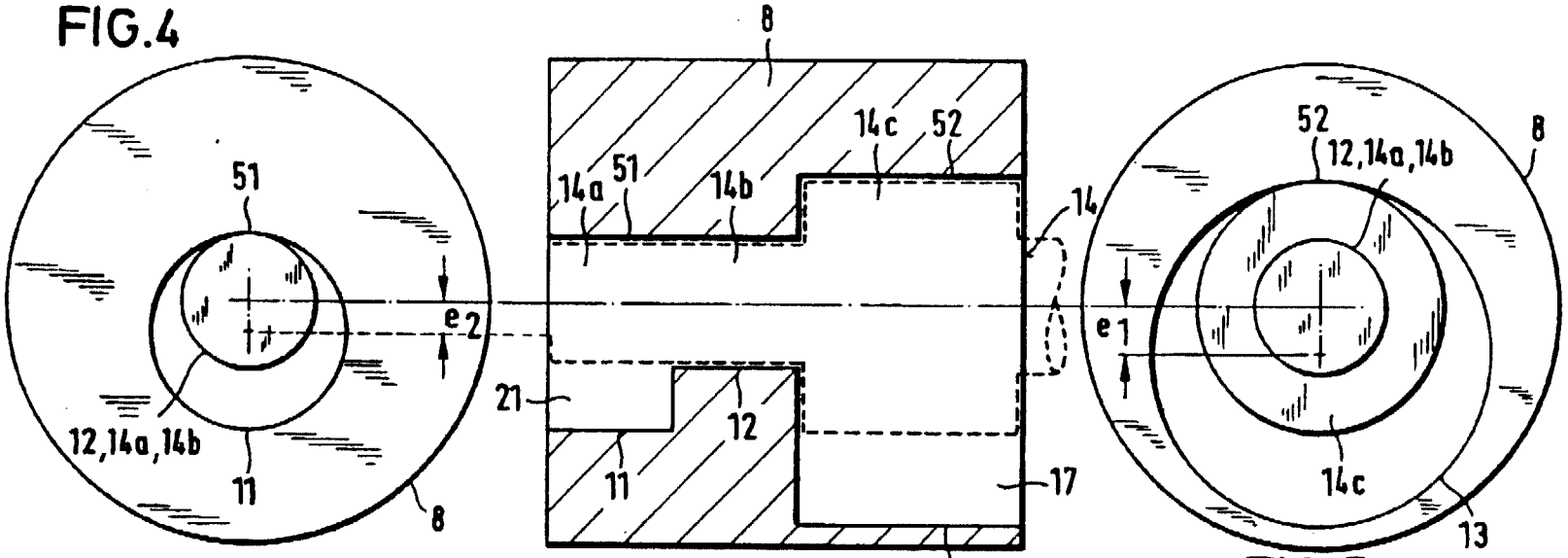
FIG.4
FIG.3
FIG.5
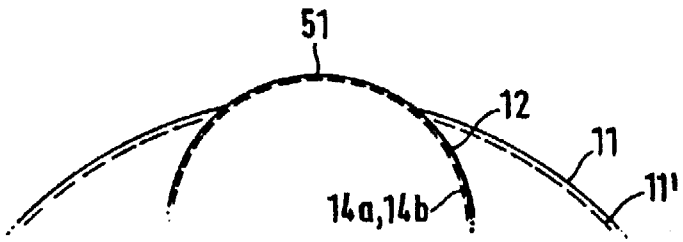
FIG.6

METHOD FOR ASSEMBLING A ONE-PIECE ROTOR SYSTEM AND A PUMP RING FOR A TWO-STAGE VACUUM PUMP

BACKGROUND OF THE INVENTION

The invention relates to a method for making a pump ring for a two-stage vacuum pump with a one-piece rotor system of three sections whose end sections form the two pump stages and whose middle section forms an intermediate bearing, the diameters of the bearing section and of the rotor section forming the first vacuum stage being equal.

It is known from DE-OS 23 54 039 that the designer of vacuum pumps endeavors to minimize the number of parts from which a vacuum pump is made. The two-stage vacuum pump disclosed in this patent application, however, still requires two (radially divided) pump rings, which have to be made separately. The danger of cumulative tolerances impairing pump action is thus created.

It is the object of the present invention to propose a method for the production of a pump ring of the kind described above in which the tolerances involved in the pump are appreciably reduced while achieving lower manufacturing cost.

SUMMARY OF THE INVENTION

This object is achieved in accordance with the invention in that, for the construction of the pump ring, two bores are made in a single set-up from one side of a substantially cylindrical workpiece, one of the bores forming the anchor contact as well as the bearing bore of the forepumping stage and the other the anchor contact of the high-vacuum stage, and that before or after these bores are made additional bores are made so as to form the pump chambers. In a pump ring made in this manner the bores determining the rotation of the rotor system (the two anchor contacts and the intermediate bearing) are made in a single set-up. Since the one-piece rotor can also be made in a single set-up, the inaccuracies that might still occur are very small. The bores for the pump chambers must be made in different set-ups on account of being off-center from the axis of the rotor system; any inaccuracies that might occur, however, have no effect on the rotation of the rotor system or on a precise anchor contact; the only effect they can have is the occurrence of variations with respect to the area of the anchor contact. Such variations have no appreciable effect on the characteristics of the pump.

In accordance with the invention, a method for making a pump ring for a two-stage vacuum pump comprises making a one-piece rotor system having three sections whose end sections form two pump stages and the middle section forms a middle bearing, the bearing middle section and one of the rotor end sections forming the forepumping stage having diameters which are equal. The method includes making two bores in a single set-up (i.e. while the pump ring is held in one and the same fixture) by two boring operation in a substantially cylindrical workpiece on one end of the latter, of which the one forms the anchor contact of the forepumping stage as well as the bearing bore and the other forms the anchor contact of the high vacuum stage. The method also includes forming additional bores for the formation of the pump chambers before or after the formation of the aforesaid two bores.

For a better understanding of the invention, together with other and further objects thereof, reference is made to the following description, taken in connection with the accompanying drawings, and its scope will be pointed out in the appended claims.

BRIEF DESCRIPTION OF THE DRAWINGS

Referring now to the drawings:

FIG. 3 shows a simplified longitudinal section through the pump ring.

FIGS. 4 and 5 are views of its front ends, and

FIG. 6 is an enlarged representation of the anchor contact of the forestage.

DESCRIPTION OF PREFERRED EMBODIMENTS

Figure 1:
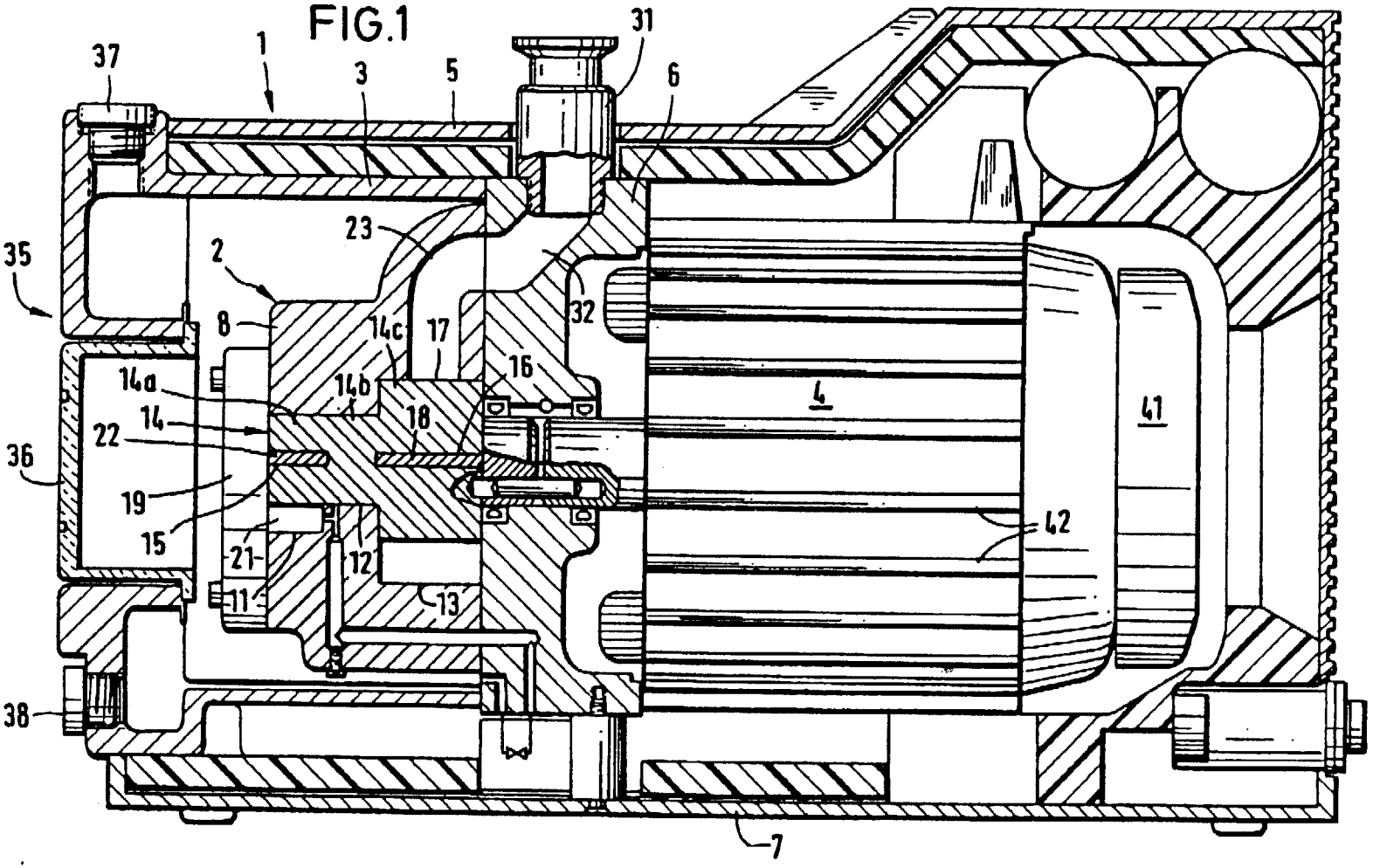
FIG. 1 and FIG. 2 show sections through a rotary vane vacuum pump configured in accordance with the invention.

The two-stage vacuum pump 1 represented in the figures as an example of the embodiment of the invention includes the actual pump case 2, the oil tank 3 surrounding the pump case, the motor 4, and the outer case or hood 5. The pump case 2 and the motor 4 are fastened on a plate 6 which rests on the floor on a base plate 7.

A component of the pump case 2 is the pump ring 8 which is made in one piece and whose opening has three areas 11, 12 and 13 each of a different configuration. Within the pump ring 8 is the rotor system 14, also made in one piece, with the sections 14*a*, 14*b* and 14*c*. The outer two sections 14*a* and 14*c* are equipped with vane slots 15 and 16 which are accessible from the ends and form the anchor of the high-vacuum and forepumping stages, respectively.

The middle section 14*b* of the rotor system 14 corresponds in its length and its diameter to the middle portion 12 of the opening of the pump ring 8 such that this area serves as a friction bearing for the rotor system 14. The area 13 of the pump ring 8, which is larger than the area 12, forms together with the plate 6 the intake chamber 17 of the high-vacuum (HV) stage of the pump 1. The slider of the forepump stage (FP) is marked 22.

Figure 2:
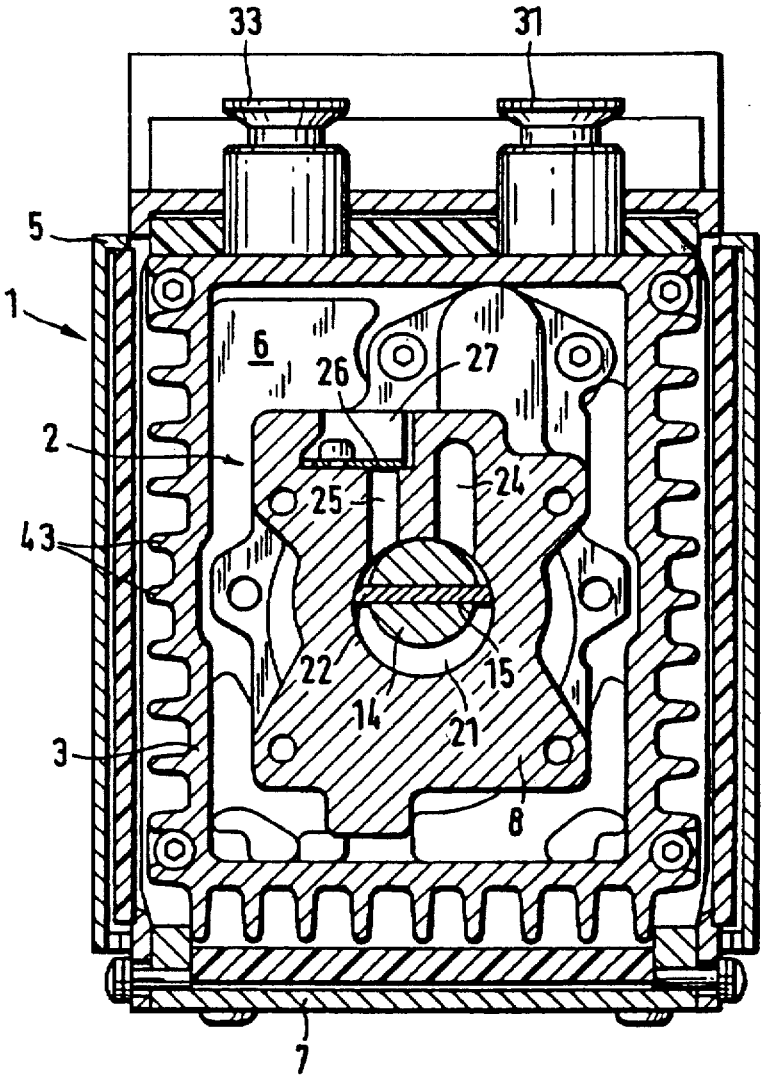

The inlet passage of the HV stage is marked 23. The passage running from the outlet of the HV stage to the inlet of the FP stage is represented only in FIG. 2 and is marked 24. The outlet valve 26 is associated with the outlet passage 25 (FIG. 2) of the FP stage. The outlet valve 26 is configured as a non-return valve and holds the vacuum in the tank if the pump fails. The valve 26 is disposed in the upper part of the pump case 2. It is situated on the bottom of a recess 27 which forms an intermediate oil reservoir during the operation of the vacuum pump.

The inlet connection 31 of the illustrated vacuum pump is fastened to the plate 6. It is connected to the inlet passage 23 of the HV stage by a bore 32 in plate 6. The outlet connection 33 is also fastened to the plate 6. It is in communication with the inner chamber of the oil tank 3 through a bore corresponding to bore 32.

Also component of the oil tank 3 is a dome 35 disposed on the end of the oil tank. Its middle section 36 is transparent and serves for checking the oil level in the oil tank 3. The dome 35 has an approximately half-round cross section whose broad side faces the oil tank 3. It extends over the entire height of the oil tank 3, so that it can be equipped with the oil filler 37 and the oil drain opening 38.

The motor 4 is equipped on its front end with a fan 41. The stream of cooling air produced by this fan serves not only for cooling the motor but also for cooling the oil tank 3. Both the motor case and the oil tank 3 are equipped with cooling fins 42 and 43 running respectively axially and horizontally.

The one-piece rotor system 14 is drawn in broken lines in the pump ring 8 of FIG. 3. For the production of the pump ring, first two bores are made in the high-vacuum end (FIG. 5), in any desired order. One bore has a diameter corresponding to that of the bearing bore 12 and simultaneously forms the anchor contact 51 of the forepumping stage. The second bore made in the same set-up forms the anchor contact 52 of the high-vacuum stage. After that (or before making the above-described bores) the bores 11 and 13 can be made for the pump chambers 17 and 21. On account of the eccentricities $e_1$ and $e_2$ a change in the set-up must sometimes be undertaken. The bores 11 and 13 are made from the corresponding ends.

FIG. 6 shows by way of example that, in making the bore 11 for the pump chamber 21 of the forepumping stage 11, 14*a*, the position of the anchor contact 51 itself is no longer affected by the tolerances that occur (bore 11 and the broken-line bore 11'). Only the surface with which the rotor 14*a* contacts the anchor contact is different.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Method for assembling a one-piece rotor system and a pump ring for a two-stage vacuum pump (1) comprising:

making a one-piece rotor system (14) having three sections (14*a*, *b c*) comprising two end sections and a middle section whose end sections (14*a* and 14*c*) form two pump stages and whose middle section (14*b*) forms a middle bearing, the bearing middle section (14*b*) and one of the rotor end sections (14*a*) forming a forepumping stage having diameters which are equal, making a pump ring having two bore in a generally cylindrical workpiece while the workpiece is held in one and the same fixture by two boring operations on one end of the workpiece including forming an anchor contact on one of said two bores corresponding with the rotor system sections 14*a*, 14*b* of the forepumping stage as well as forming a bearing bore (12) in the middle section of the workpiece corresponding with the middle bearing section and including forming an anchor contact on another of said two bores corresponding with another rotor end system section 14*c* of a high-vacuum stage, and forming additional bores (11, 13) for formation of pump chambers (21, 17) at a different time from the formation of said two bores, thereby making a pump ring, and assembling said one piece rotor system into said pump ring.

2. Method according to claim 1, which includes making a pump ring (8) in one piece.

3. Method according to claim 2, in which the step of making two bores comprises making a diameter of the bore determining the anchor contact (52) of the high-vacuum stage greater than a diameter of the bore determining the anchor contact (51) of the forepumping stage.

* * * * *

UNITED STATES PATENT AND TRADEMARK OFFICE

CERTIFICATE OF CORRECTION

PATENT NO. : 5,155,908

DATED : October 20, 1992

INVENTOR(S) : Lutz Arndt et al

It is certified that error appears in the above-identified patent and that said Letters Patent is hereby corrected as shown below:

Abstract, line 7 for "(14band" read

-- (14b) and --.

Column 4, line 12 for "two bore" read

-- two bores --.

Signed and Sealed this

First Day of March, 1994

*Attest:*

*Attesting Officer*

BRUCE LEHMAN

*Commissioner of Patents and Trademarks*